United States Patent [19]

Haga et al.

[11] Patent Number: 4,733,162

[45] Date of Patent: Mar. 22, 1988

[54] THERMAL SHUTOFF CIRCUIT

[75] Inventors: Hiroyuki Haga, Tokyo; Mitsuru Nagata; Hiromi Kusakabe, both of Yokohama, all of Japan

[73] Assignee: Kabushiki Kaisha Toshiba, Kawasaki, Japan

[21] Appl. No.: 936,159

[22] Filed: Dec. 1, 1986

[30] Foreign Application Priority Data

Nov. 30, 1985 [JP] Japan ..... 60-269676

[51] Int. Cl.[4] ..... G05F 3/20

[52] U.S. Cl. ..... 323/316; 323/317; 323/907

[58] Field of Search ..... 323/312–314, 323/315, 316–317, 907; 307/296 R, 297, 310; 330/288

[56] References Cited

U.S. PATENT DOCUMENTS

| | | | |
|---|---|---|---|
| 4,008,441 | 2/1977 | Schade, Jr. | 323/315 |
| 4,283,673 | 8/1981 | Lieux | 323/316 |
| 4,380,740 | 4/1983 | Kaplan | 323/316 X |
| 4,381,484 | 4/1983 | Jarrett | 323/316 |
| 4,528,496 | 7/1985 | Naokawa et al. | 323/316 X |
| 4,553,048 | 11/1985 | Bynum et al. | 323/315 X |

OTHER PUBLICATIONS

"Audio/Radio Handbook", National Semiconductor Corporation, 1980, p. 4—4.

*Primary Examiner*—Peter S. Wong
*Attorney, Agent, or Firm*—Finnegan, Henderson, Farabow, Garrett & Dunner

[57] ABSTRACT

A thermal shutoff circuit for controlling current to an external circuit in response to changes in the temperature of the shutoff circuit. The thermal shutoff circuit includes a source for supplying a voltage which varies with changes in temperature, and a switch circuit responsive to the temperature variable voltage for interrupting the current to the external circuit when the temperature of the shutoff circuit exceeds a predetermined amount. The switch circuit has a detection transistor having a base connected to the temperature variable voltage source for generating a base current responsive to the temperature variable voltage and a compensation transistor connected in series to the detection transistor for generating an equivalent base current.

15 Claims, 9 Drawing Figures

THERMAL SHUTOFF CIRCUIT

BACKGROUND OF THE INVENTION

1. Field of the Invention

The present invention relates to a thermal shutoff circuit operable in response to a temperature, and more particularly to a thermal shutoff circuit for protecting an external circuit by shutting off a bias current to be supplied to the external circuit when the surrounding temperature rises above a prescribed level.

2. Description of the Prior Art

Conventionally, a thermal shutoff circuit, as shown in FIG. 1, is used together with an external circuit such as an amplifier circuit (not shown in the drawing). In FIG. 1, a first constant current source 13 and a Zener diode 14 are connected in series between a power supply terminal 11 with a voltage Vcc and a reference potential terminal 12 with a ground potential (GND). The voltage of a Zener diode varies in response to temperature, as is well known. The anode of zener diode 14 is connected to the base of an NPN transistor 15 for detecting a temperature change. Detection transistor 15 is connected at its collector to power supply terminal 11, and at its emitter to reference potential terminal 12 through a voltage divider comprised of a series circuit of resistors 16, 17. The voltage division node of the voltage divider, i.e., the connection node of resistors 16, 17 is connected to the base of an NPN transistor 18 for shutoff control, as described later. A second constant current source 19 and an NPN transistor 20 supply an external circuit, such as an amplifier circuit (not shown), with a bias current. The source 19 and the transistor 20 are connected between power supply terminal 11 and reference potential terminal 12 in series. Bias supply transistor 20 is connected in a diode fashion, by itself. That is, the collector and the base of bias supply transistor 20 are directly connected to one another. The collector of shutoff control transistor 18 is connected to the connection node of constant current source 19 and bias supply transistor 20. The base of bias supply transistor 20 is connected to an output terminal OUT for supplying the external circuit with the bias current.

In the conventional circuit, as described above, a first constant current I13 is produced by first constant current source 13 and flows into zener diode 14. This produces a zenor voltage Vz across zener diode 14. Zener voltage Vz has prescribed temperature characteristics, so that it varies in accordance with temperature, as described in detail later. Zener voltage Vz is applied to the base of detection transistor 15. A current flowing through detection transistor 15 varies in accordance with zener voltage Vz. Thus detection transistor 15 detects temperature change by the variation of its current. The detection result is obtained as a potential change on the emitter of transistor 15. The emitter potential of detection transistor 15 is divided by the voltage divider of resistors 16, 17 so that a prescribed voltage, i.e., a voltage across resistor 17 is given on the base of shutoff control transistor 18. The voltage is applied to the base of shutoff control transistor 18 and is referred to as Vb18 hereinafter.

Second constant current source 19 produces a second constant current I19. When constant current I19 flows into bias supply transistor 20, bias supply transistor 20 operates to draw the bias current as its base current from the external circuit through output terminal OUT.

At that time, a base potential of a prescribed level exists on the base of bias supply transistor 20, i.e., on output terminal OUT. When constant current I19 fails to flow into bias supply transistor 20, i.e., constant current I19 flows into shutoff control transistor 18, as described in detail later, bias supply transistor 20 fails to draw the bias current from the external circuit. At that time, the external circuit is shut off.

Base potential Vb18 of shutoff control transistor 18 is expressed by the following equation.

$$Vb18 = (Vz = Vb15)\frac{R17}{R16 + R17} \quad (1)$$

In this equation, Vb15 is the base-to-emitter voltage of detection transistor 15, and R16 and R17 are the resistances of resistors 16, 17, respectively. Vbe generally represents the base-to-emitter voltage of a transistor when the transistor is activated.

As is well known, the zener voltage V2 of a zener diode has a positive temperature characteristic, while the base-to-emitter voltage Vbe of a transistor has a negative temperature characteristic. In the equation (1), therefore, base potential Vb18 of shutoff control transistor 18 has a positive temperature characteristic. In other words, base potential Vb18 of shutoff control transistor 18 increases as temperature rises.

The base-to-emitter voltage Vbe18 of shutoff control transistor 18 has a negative temperature characteristic similar to base-to-emitter voltage Vbe15 of detection transistor 15, mentioned above. That is, base-to-emitter voltage Vbe18 of shutoff control transistor 18 decreases as the temperature rises.

As an example, assume that resistances R16, R17 of resistors 16, 17 are set so that both base potential Vb18 and base-to-emitter voltage Vbe18 of shutoff control transistor 18 agree with each other at a prescribed temperature T1 higher than a normal temperature Tn. Thus, Vb18(T1)=Vbe18(T1) at temperature T1. In this state, shutoff control transistor 18 is deactivated at normal temperature Tn. This is because base potential Vb18(Tn) of shutoff control transistor 18 at temperature Tn is lower than base potential Vb18(T1) at temperature T1, while base-to-emitter voltage Vbe18(Tn) of shutoff control transistor 18 at normal temperature Tn is higher than base-to-emitter voltage Vbe18(T1) at temperature T1. In other words, base potential Vb18(Tn) is below the level required to activate shutoff control transistor 18, i.e., the prescribed base-to-emitter voltage Vbe18(Tn). Therefore, second constant current I19 from second constant current source 19 flows only into bias supply transistor 20, and not into shutoff control transistor 18. As a result, bias supply transistor 20 draws the bias current from the external circuit through output terminal OUT. Therefore, the thermal shutoff circuit supplies the external circuit with the bias current at temperature Tn.

When temperature goes up to another prescribed temperature T2 above temperature T1, shutoff control transistor 18 is activated. This is because base potential Vb18(T2) of shutoff control transistor 18 at temperature T2 is higher than base potential Vb18(T1) at temperature T1, while base-to-emitter voltage Vbe18(T2) of shutoff control transistor 18 at temperature T2 is lower than base-to-emitter voltage Vbe18(T1) at temperature T1. In other words, base potential Vb18(T2) is sufficient to activate shutoff control transistor 18 at temperature T2. Therefore, second constant current I19 flows into shutoff control transistor 18. At this time, bias supply transistor 20 is deactivated due to the shortage of current flowing therethrough. As a result, bias supply transistor 20 fails to draw the bias current from the external circuit through output terminal OUT. That is, the thermal shutoff circuit shuts off the supply of the bias current and protects the external circuit from thermal breakdown, when the surrounding temperature exceeds the prescribed temperature T1.

However, in the conventional thermal shutoff circuit shown in FIG. 1, zener diode 14 is used as a voltage source which varies in response to temperature. Zener diodes, however, generally have zener voltages as high as 7 volts. As a result, the conventional thermal shutoff circuit, as shown in FIG. 1, requires a very high power supply voltage Vcc above the zener voltage, e.g., at least 8 volts. The conventional thermal shutoff circuit, therefore, is inappropriate for use in battery driven apparatus. Moreover, the conventional thermal shutoff circuit has a drawback in that it consumes a relatively large amount of power due to the high power supply voltage.

A second conventional thermal shutoff circuits, as shown in FIG. 2, is an improvement over the first conventional thermal shutoff circuit shown in FIG. 1. The differences between the first and second conventional thermal shutoff circuits will be described in detail hereinafter. In FIG. 2, a so-called $V_T$ referenced type constant current source 21 is used as the source for temperature responsive variable voltage. $V_T$ referenced type constant current source 21 is comprised of three PNP transistors 22, 24, 26, two NPN transistors 23, 25 and two resistors 27, 28. PNP transistors 22, 24, and 26 are connected with each other in the form of a current mirror circuit. That is, their bases are connected together and their emitters are connected to power supply terminal 11. Further, one PNP transistor, e.g., PNP transistor 24 is connected in diode fashion. NPN transistors 23, 25 also have their bases connected together. One NPN transistor, e.g., NPN transistor 25 is connected directly at its emitter to reference potential terminal 12. NPN transistor 23 is connected in diode fashion to itself and its emitter is connected to reference potential terminal 12 through resistor 27. The diode fashion NPN transistor, i.e., NPN transistor 23 is connected at its collector to the collector of PNP transistor 22. NPN transistor 25 is connected at its collector to the collector of the diode fashion PNP transistor 24. NPN transistor 23 has an emitter area N times larger than NPN transistor 25, N being a number larger than 1 (N>1). PNP transitor 26 is connected at its collector to reference potential terminal 12 through resistor 28. The rest of the circuit shown in FIG. 2 is equivalent to the circuit shown in FIG. 1, i.e., the first conventional thermal shutoff circuit. For example, PNP transistor 26 is connected at its collector to the base of detection transistor 15.

As is well known $V_T$ referenced type constant current sources generate a voltage which varies in response to temperature. The voltage generated in $V_T$ referenced type constant current source 21 will be referred as thermal voltage Vt hereinafter and can be expressed by the following equation.

$$Vt = \frac{k \cdot T}{q} \tag{2}$$

In this equation, K represents the Boltzman's constant, T represents the absolute temperature and Q represents the electron charge.

Therefore, a current I27 expressed by the following equation flows through resistor 27.

$$I27 = \frac{1}{R27} Vt \cdot \ln N \tag{3}$$

In this equation, R27 is a resistance of resistor 27.

An equivalent current flows through PNP transistor 26 in the current mirror circuit. This current, therefore, flows into resistor 28, so that a voltage V28 exists across resistor 28 and is applied to the base of detection transistor 15. Voltage V28 is expressed by the following equation.

$$V28 = \frac{R28}{R27} \cdot Vt \cdot \ln N = Kr \cdot Vt \cdot \ln N$$

In this equation, R28 is the resistance of resistor 28 and Kr is a constant representing the ratio of resistance R28 to resistance R27.

Base potential Vb18 of shutoff control transistor 18 can be expressed by the following equation.

$$Vb18 = V17 = (V28 - Vbe15) \cdot \frac{R17}{R16 + R17} \tag{4}$$

$$= (Kr \cdot Vt \cdot \ln N - Vbe15) \cdot \frac{R17}{R16 + R17}$$

In this equation, V17 is the voltage across resistor R17.

Voltage V28, therefore, has the same temperature characteristic as thermal voltage Vt obtained in $V_T$ reference type constant current source 21. As a result, the second conventional bias shutoff circuit shuts off the supply of the bias current to the external circuit and protects the external circuit from thermal breakdown when the temperature exceeds a prescribed temperature T1.

The second conventional thermal shutoff circuit shown in FIG. 2 has merit in that it operates at a low power supply voltage. However, the prescribed temperature at which the circuit operates to shut off the bias current varies in different integrated circuits. This is because a factor determining the prescribed temperature, i.e., the base-to-emitter voltage Vbe of the transistors, is a function of the current amplification ratio $\beta$ of the transistors as expressed by the following equation.

$$Vbe = Vt \cdot \ln \frac{Ic}{Is} = Vt \cdot \ln \frac{\beta \cdot Ib}{Is} \tag{5}$$

In this equation, Ic is a collector current of the transistors, Is is the saturated current of transistors and Ib is the base current of transistors.

As is well known, the current amplification ratio $\beta$ varies in every different circuit device such as an integrated circuit chip. The current amplification ratio varies over a wide range, for example, from about 70 to about 300. Therefore, in the second conventional thermal shutoff circuit, the prescribed temperature differs over a wide range and it is not feasible to use such a shutoff circuit with different integrated circuits.

The same drawback also occurs in the first conventional thermal shutoff circuit shown in FIG. 1. That is, the circuit of FIG. 1 also uses the base-to-emitter voltage Vbe as a factor for determining the prescribed temperature.

SUMMARY OF THE INVENTION

Accordingly, an object of the present invention is to provide a thermal shutoff circuit in which a prescribed temperature at which the circuit operates to shut off a supply of a bias current to an external circuit may be stably set for use with a variety of different circuits.

Another object of the present invention is to provide a thermal shutoff circuit in which the prescribed temperature, at which the circuit operates to shut off a supply of a bias current to an external circuit is relatively uniform for different circuits.

A further object of the present invention is to provide a thermal shutoff circuit in which a prescribed temperature at which the circuit operates to shut off a supply of a bias current to an external circuit is not influenced by the current amplification ratio $\beta$ of transistors in the shutoff circuit.

A still further object of the present invention is to provide a thermal shutoff circuit which operates at a relatively low power supply voltage.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

In order to achieve the above objects, the thermal shutoff circuit for controlling current to an external circuit in response to changes in the temperature of the shutoff circuit includes a source for supplying a voltage which varies with changes in temperature, and a switch circuit responsive to the temperature variable voltage for interrupting the current to the external circuit when the temperature of the shutoff exceeds a predetermined amount. The switch circuit has a detection transistor having a base connected to the temperature variable voltage source for generating a base current responsive to the temperature variable voltage and a compensation transistor connected in series to the detection transistor for generating an equivalent base current.

DESCRIPTION OF THE PREFERRED EMBODIMENTS

Figure 1:
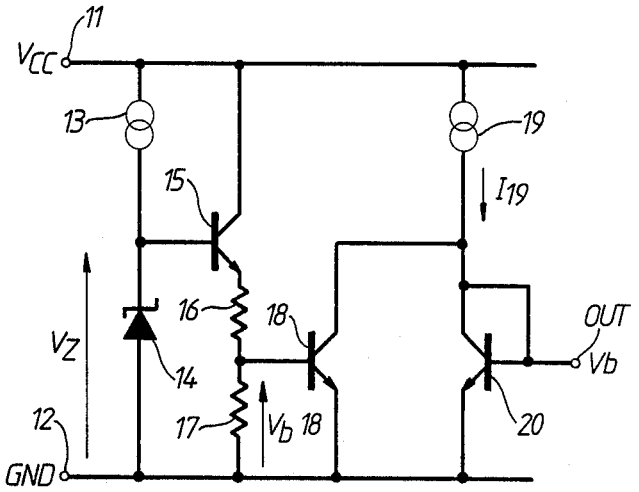
FIG. 1. (PRIOR ART)
FIGS. 1 and 2 are circuit diagrams showing conventional thermal shutoff circuits, respectively.
Figure 2:
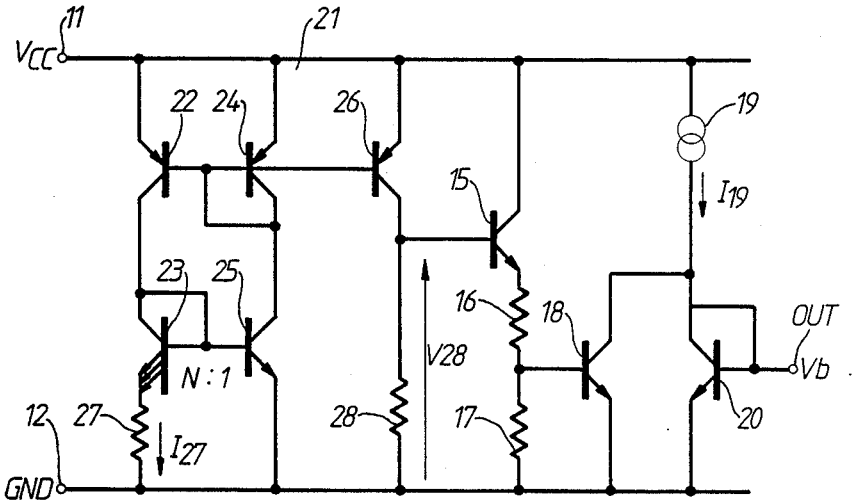
FIG. 2. (PRIOR ART)

The present invention will now be described in detail with reference to the accompanying drawings, namely, FIGS. 3 to 9. Throughout the drawings, like reference numerals and letters are used to designate elements like or equivalent to those used in FIGS. 1 and 2 (prior arts) for the sake of simplicity of explanation.

Figure 3:
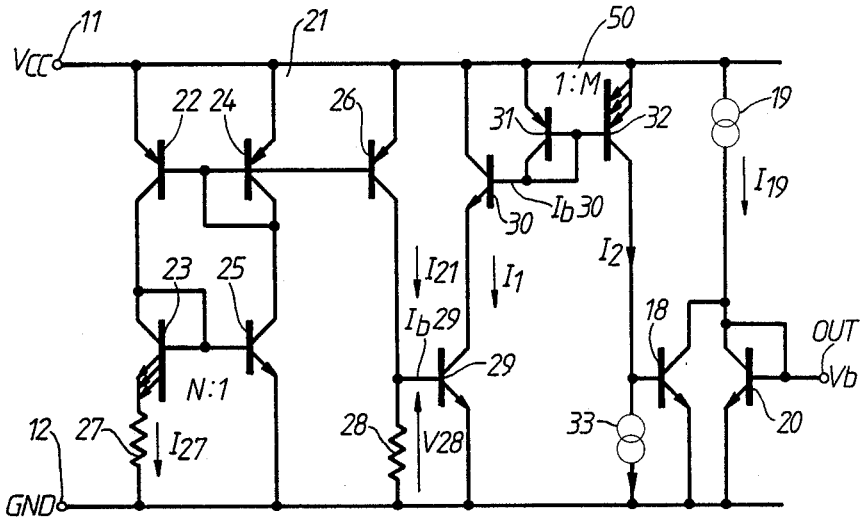
FIG. 3 is a circuit diagram showing an embodiment of the thermal shutoff circuit according to the present invention.

Referring now to FIG. 3, an embodiment of the present invention will be described in detail below. In FIG. 3, a $V_T$ referenced type constant current source 21 is used as the source for giving the voltage which varies in response to temperature, similar to the second conventional thermal shutoff circuit shown in FIG. 2. $V_T$ referenced type constant current source 21 is comprised of three PNP transistors 22, 24, 26, two NPN transistors 23, 25 and two resistors 27, 28. PNP transistors 22, 24, 26 are connected in a form of a current mirror circuit with each other. That is, their bases are connected together and their emitters are connected to power supply terminal 11. Further, one PNP transistor, e.g., PNP transistor 24 is connected in the diode fashion. NPN transistors 23, 25 are connected at their bases. One NPN transistor, e.g., NPN transistor 25 is directly connected at its emitter to reference potential terminal 12. NPN transistor 23 is connected in diode fashion to itself and further at its emitter to reference potential terminal 12 through resistor 27. The diode fashion NPN transistor, i.e., NPN transistor 23 is connected at its collector to the collector of PNP transistor 22. NPN transistor 25 is connected at its collector to the collector of the diode fashion PNP transistor, i.e., PNP transistor 24. NPN transistor 23 has an emitter area N times larger than NPN transistor 25, where N is a number larger than 1 ($N>1$), while, PNP transistor 26 is connected at its collector to reference potential terminal 12 through resistor 28.

A connection node of PNP transistor 26 and resistor 28 in $V_T$ referenced type constant current source 21 is connected to the base of an NPN transistor 29 for detecting a temperature change. Detecting transistor 29 is connected at its collector to power supply terminal 11 through an NPN transistor 30 and is also connected at its emitter directly to reference potential terminal 12. NPN transistor 30 is connected at its base to a second current mirror circuit 50 which is comprised of two PNP transistors 31, 32. PNP transistors such as PNP transistors 22, 24, 26, 31 and 32 are generally constituted in the integrated circuits in the form of the lateral transistor construction. In second current mirror circuit 50, the bases of both PNP transistors 31, 32 are connected together and their emitters are directly connected to power supply terminal 11. Further, one PNP transistor, e.g., PNP transistor 31 is connected in diode fashion to itself. The collector of PNP transistor 31 is connected to the base of NPN transistor 30. PNP transistor 32 has an emitter area M ($M>1$) times larger than PNP transistor 31. The collector of PNP transistor 32 is connected to reference potential terminal 12 through a second constant current source 33. A connection node of PNP transistor 32 of second current mirror circuit 50 and second constant current source 33 is connected to the base of an NPN transistor 18 for the shutoff control as described before in the description of the conventional circuits shown in FIG. 1. A third constant current source 19 and an NPN transistor 20, for supplying an external circuit such as an amplifier circuit (not shown)

with a bias current, is connected between power supply terminal 11 and reference potential terminal 12 in series. The bias supply transistor, i.e., NPN transistor 20 is connected in a diode fashion to itself. That is, the collector and the base of bias supply transistor 20 are connected to one another directly. The collector of the shutoff control transistor, i.e., NPN transistor 18 is connected to the connection node of third constant current source 19 and bias supply transistor 20. The base of bias supply transistor 20 is connected to an output terminal OUT for supplying the external circuit with the bias current.

In the circuit as described above, a first constant current I21 is produced by $V_T$ referenced type constant current source 21 and flows into resistor 28. Therefore, a voltage V28 expressed as the following equation appears across resistor 28.

$$V28 = I21 \cdot R28 \quad (6)$$

Where R28 is a resistance of resistor 28.

Current I21 can be expressed by the following equation since $V_T$ referenced type constant current source 21 is used, as described in the description for the second conventional thermal shutoff circuit.

$$I21 = \frac{1}{R27} \cdot Vt \cdot \ln N \quad (7)$$

Then the equation (6) may be changed to the following equation.

$$V28 = \frac{R28}{R27} \cdot Vt \cdot \ln N = Kr \cdot Vt \cdot \ln N \quad (8)$$

Base potential Vb29 of detection transistor 29 varies as a function of the thermal voltage Vt so that base potential Vb29 has a positive temperature characteristic, while the base-to-emitter voltage Vbe29 of detection transistor 29 has a negative temperature characteristic.

Now assume that resistances R27, R28 of resistors 27, 28 are set so as that both base potential Vb29 and base-to-emitter voltage Vbe29 of detection transistor 29 agree with each other at a prescribed temperature T1 higher than a normal temperature Tn. That is, a relation Vb29(T1)=Vbe29(T1) comes in force at the prescribed temperature T1. Then, shutoff control transistor 29 is activated at a temperature T2 higher than the prescribed temperature T1 because base potential Vb29(T2) of detection transistor 29 at temperature T2 is higher than base potential Vb29(T1) at temperature T1, while base-to-emitter voltage Vbe29(T2) of detection transistor 29 at temperature T2 is lower than base-to-emitter voltage Vbe29(T1) at the prescribed temperature T1. In other words, base potential Vb29(T2) is high enough at the necessary level to obtain the prescribed base-to-emitter voltage Vbe29(T2) so that detection transistor 29 become active at temperature T2. Therefore, detection transistor 29 becomes active at a temperature over the prescribed temperature T1 allowing a current I1 to flow through transistors 30 and 29. In the above operation, base currents Ib29 and Ib30 flow into the bases of transistors 29 and 30, respectively. Base currents Ib29 and Ib30 are applied from $V_T$ referenced type constant current source 21 and current mirror circuit 50, respectively.

Here, base current Ib29 on the base of detection transistor 29 equals base current Ib30 on the base of transistor 30. That is, temperature change over the prescribed temperature T1 is detected by detection transistor 29 and transistor 30 gives base current Ib30, not a collector current, as a result of the detection of temperature change. Base currents Ib29 and Ib30 are equal to each other when transistors 29 and 30 are fabricated in positions close to each other in integrated circuit chips. Further, base currents of transistors are not influenced by the current amplification ratio $\beta$ and are almost uniform in every integrated circuit chip.

Base current Ib30 of transistor 30 is too small for activating shutoff control transistor 18. Thus, current mirror circuit 50 operates to increase base current Ib30 to a sufficient amount. That is, PNP transistor 32 flows a current I2 which is M times greater than base current Ib30 therethrough, when the same current as base current Ib30 flows through PNP transistor 31. That is, current I2 is given as the following equation.

$$I2 = M \cdot Ib30 = M \cdot Ib29 \quad (9)$$

When temperature is below the prescribed temperature T1, current I2 fails to flow so that constant current source 33 and shutoff control transistor 18 are left in OFF state, respectively. At this time, a constant current I19 of constant current source 19 flows into bias current supply transistor 20 only. Therefore, bias current supply transistor 20 draws the bias current from the external circuit through output terminal OUT.

When temperature rises over the prescribed temperature T1, detection transistor 29 is activated so that current I2 of the equation (9) begins to flow. Then, constant current source 33 is turned ON. When current I2 reaches a previously-set constant current value I33, an excess amount of current I2 over the set amount of constant current I33 flows into the base of shutoff control transistor 18 as its base current. Therefore, shutoff control transistor 18 operates so that shutoff control transistor 18 draws constant current I19 of constant current source 19. At this time, bias supply transistor 20 is set in an OFF state, and the bias current to be supplied to the external circuit, such as amplifier circuits, is interrupted and the thermal shutoff operation of the circuit is completed. That is, in the thermal shutoff circuit described above, a bias voltage Vb corresponding to the bias current appears on output terminal OUT until the temperature reaches the prescribed temperature T1 and until the base potential Vb29 of detection transistor 29 exceeds the specified base-to-emitter current Vbe29(T1) at the prescribed temperature T1.

As is well known, current mirror circuits have a current gain characteristic which is independent of the current amplification ratio $\beta$. Therefore, the detection result of temperature over the prescribed temperature T1 at detection transistor 29 is transmitted to shutoff control transistor 18 by currents related only to the base currents of transistors. Therefore, the embodiment of the thermal shutoff circuit of the present invention is saved from the influence of the current amplification ratio $\beta$ on, for example, the series circuit of transistors 30, 29 or current mirror circuit 50.

Therefore, the embodiment of the thermal shutoff circuit, according to the present invention, is designed to reduce variations in the detection temperature due to variations in the current amplification ratio in different integrated circuit chips caused by manufacturing problems.

Figure 4:
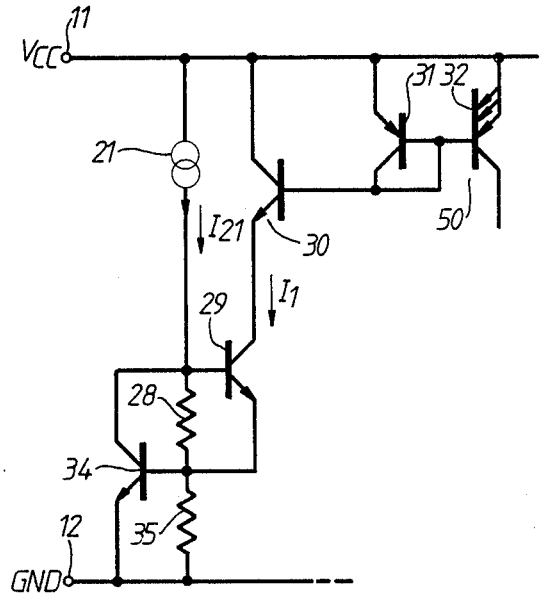
FIG. 4 is a circuit diagram showing a modification for preventing an unlimited increase of current I1 in transistors 30, 29 of FIG. 3.

In the thermal shutoff circuit described above, however current I1 flowing through transistors 30, 29 increases without limit according to a rise in temperature resulting in a possibility of destruction of circuit elements. FIG. 4 shows a circuit diagram for preventing the unlimited increase of current I2 in the above embodiment.

In FIG. 4, the current limiting circuit is comprised of an NPN transistor 34 and a resistor 35. Resistor 35 is connected between resistor 28 and reference potential terminal 12. Detection transistor 29 is connected at its emitter to the connection node of both resistors 28, 35. Current limiting transistor 34 is connected at its collector emitter path between the base of detection transistor 29 and reference potential terminal 12 and at its base to the connection node of both resistors 28, 35.

In operation at a normal temperature Tn, i.e., a temperature below the prescribed temperature T1, a voltage V28 across resistor 28 and a voltage V35 across resistor 35 fail to reach specified base-to-emitter voltages Vbe29(ON) and Vbe34(ON) necessary for activation of transistors 28, 34 thereby placing transistors 28 and 34 in an OFF state. Voltage V28 is given in the equation, i.e., V28=I21·R28, while voltage V35 is given in the equation, i.e., V35=I21·R35, where R35 is a resistance of resistor 35. Now assume that a relation, R28>R35 is set. Detection transistor 29 is turned ON first at the prescribed temperature T1 with a rise of temperature but current limiting transistor 34 is still left in an OFF state. At this time, current I1 begins to flow through transistors 30 and 29 as described before. Current I1 increases when temperature further rises from the prescribed temperature T1. The increased current I1 is added to current I21 in resistor 35.

When voltage V35 (V35=[I21+I1]·R35) has reached the specified base-to-emitter voltage Vbe34(ON) at another prescribed temperature T2 over the first prescribed temperature T1 (i.e., T2>T1), current limiting transistor 34 is turned ON. Current limiting transistor 34 then draws current I21 into its collector to emitter path. At this time, the current in resistor 28 is reduced and voltage V28 is limited against an excessive biasing for detection transistor 29. As a result, the unlimited increase of current I1 is avoided by the current limiting circuit as shown in FIG. 4.

Also, in the thermal shutoff circuit of FIG. 3, lateral construction PNP transistors 31 and 32 are used in current mirror circuit 50 for amplifying base current Ib30 (Ib30=Ib29) to a sufficient amount. Generally, the base current of transistors is very small in comparison to the collector current. Therefore, it is necessary to make the emitter area ratio M between lateral PNP transistors 31, 32 a fairly large value, for example, a value of at least 100. However, lateral PNP transistors with a unit emitter area similar to transistor 31 occupy a very large area on integrated circuit chips. Therefore, it is impossible to form the lateral PNP transistors with such a large value of the emitter area ratio on integrated circuit chips.

Figure 5:
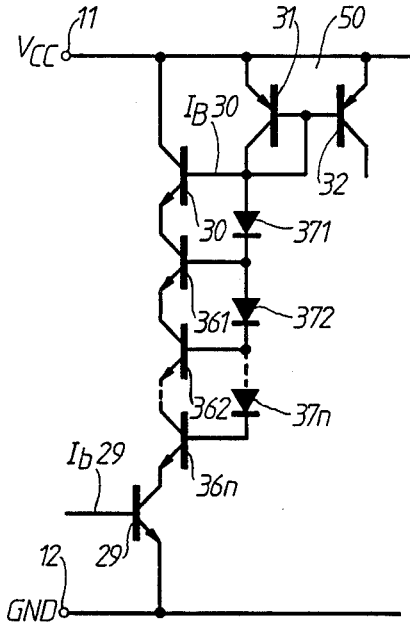
FIGS. 5 and 6 are circuit diagrams showing modifications for improvements of current mirror circuit 50 in the thermal shutoff circuit shown in FIG. 3.

FIG. 5 shows a circuit diagram for one improvement of current mirror circuit 50 in the thermal shutoff circuit shown in FIG. 3. In this circuit, a series circuit of n number of NPN transistors 361, 362, . . . , 36*n* and bias diodes 371, 372, . . . , 37*n* corresponding to NPN transistors 361, 362, . . . , 36*n* are connected between the collector of detection transistor 29 and the emitter of transistor 30, while, current mirror circuit 50 is constructed by lateral PNP transistors 31, 32 both having emitters with a small emitter area ratio.

In the circuit shown in FIG. 5, all of base currents Ib361, Ib362, . . . , Ib36*n* of NPN transistors 361, 362, . . . , 36*n* as well as base current Ib30 of transistor 30 are supplied from PNP transistor 31. Base currents Ib361, Ib362, . . . , Ib36*n* are set equal to base current Ib30. Accordingly, the current flowing through the input side, i.e., transistor 31 of current mirror circuit 50, is amplified (n+1) times in comparison to the circuit shown in FIG. 3. As a result, it is possible to make the emitter area ratio M of the transistors 31 and 32 small emough for constructing the lateral PNP transistors 31, 32 on actual integrated circuit chips. In the circuit of FIG. 5, NPN transistors 361, 362, . . . , 36*n* and bias diodes 371, 372, . . . , 37*n* are of the vertical type. As is well known, vertical construction transistors or diodes are constructed in a very small area on actual integrated circuit chips.

Figure 6:
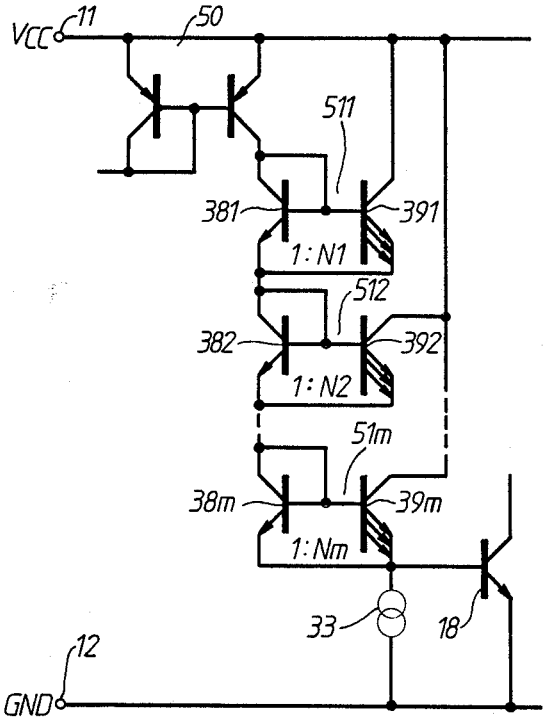

FIG. 6 shows a circuit diagram for another improvement of current mirror circuit 50 in thermal shutoff circuit shown in FIG. 3. The circuit of FIG. 6 gives substantially the same effect as the circuit of FIG. 5. In this circuit, a series circuit of m number of current mirror circuits 511, 512, . . . , 51*m* is connected between the collector of detection transistor 32 and constant current source 33. Current mirror circuits 391, 392, . . . , 39*m* are comprised of NPN transistors 381, 382, . . . , 38*m* and 391, 392, . . . , 39*m*, respectively. Respective pairs of transistors in current mirror circuits 511, 512, . . . , 51*m* have emitter area ratios N1, N2, . . . , Nm, respectively. Current mirror circuit 50 is constructed by lateral PNP transistors 31, 32 both having emitters of a unit area or have a small emitter area ratio between the pair of transistors.

In the circuit of FIG. 6, current I2 flowing through the output side of current mirror circuit 50, i.e., the collector current of PNP transistor 32, is amplified by the set of current mirror circuits 511, 512, . . . , 51*m*. That is, current I2 is amplified to [(1+N1)·(1+N2) . . . (1+Nm)]·I2. According to the circuit of FIG. 6, it is not necessary to increase the emitter areas of lateral PNP transistors 31 and 32 in current mirror circuit 50 in the same manner as in the circuit shown in FIG. 5. NPN transistors 381, 382, . . . , 38*m* and 391, 392, . . . , 39*m* of current mirror circuits 511, 512, . . . , 51*m* can be constructed by the vertical type transistors, which occupy very small areas on integrated circuit chips.

Figure 7:
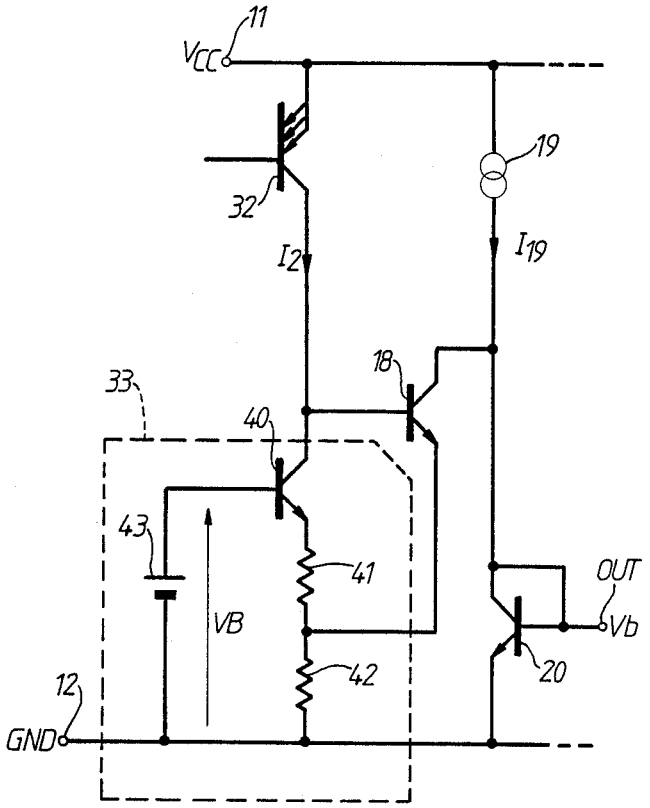
FIG. 7 is a circuit diagram showing a modification for applying a thermal hysteresis characteristic to the thermal shutoff circuit shown in FIG. 3.

FIG. 7 shows a circuit diagram for a further improvement of the thermal shutoff circuit shown in FIG. 3. The circuit of FIG. 7 gives the supply of the bias current a thermal hysteresis characteristic. In the circuit of FIG. 7, constant current source 33 is comprised of NPN transistor 40, two resistors 41, 42 and a base bias source such as a battery 43. NPN transistor 40 is connected at its collector to the base of shutoff control transistor 18 and at its emitter to reference potential terminal 12 through a series circuit of resistors 41, 42. The base of NPN transistor 40 is connected to the positive terminal of battery 43, of which the negative terminal is connected to reference potential terminal 12. The emitter of shutoff control transistor 18 is connected to the connection node of resistors 41, 42. Constant current source 33, shown in FIG. 7, supplies a constant current I33*a* expressed as the following equation when shutoff control transistor 18 is deactivated.

$$I33a = \frac{V43 - Vbe40}{R41 + R42} \quad (10)$$

Where V43 is the voltage of battery 43, Vbe 40 is the base-to-emitter voltage of transistor 40, and R41, R42 are resistances of resistors 41, 42.

The operation of the circuit of FIG. 7 will be described with reference to FIG. 8, which shows a graph of the bias current supplied to the external circuit through output terminal OUT vs. temperature T. When temperature T rises to the prescribed temperature T1, current I2 begins to flow through transistor 32 and constant current source 33. When current I2 reaches the value of current I33*a* as set by constant current source 33 shown in FIG. 7, the excessive amount of current I2 over the amount of constant current I33*a* is supplied to shutoff control transistor 18 as its base current Ib18. Therefore, shutoff control transistor 18 draws current I19 of constant current source 19. As a result, bias supply transistor 20 stops the supply of the bias current to the external circuit through output terminal OUT, as shown by the solid line in FIG. 8, and the shutoff operation of the thermal shutoff circuit is completed.

Current I19 drawn into shutoff control transistor 18 is added to current I33*a* in resistor 42. Therefore, constant current source 33 shown in FIG. 7 changes its bias condition from the condition at the time when shutoff control transistor 18 was deactivated. At this time, a new constant current value of constant current source 33 decreases to the value I33*b* expressed as the following equation, according to the new bias condition.

$$I33a = \frac{V43 - Vbe40 - R42 \cdot I19}{R41} \quad (11)$$

Therefore, if temperature T less than the prescribed temperature T1 for a period of time, current I2 from current mirror circuit 50 is no longer less than the new constant current I33*b*. Therefore, the thermal shutoff circuit is left in the shutoff operation state as shown by the broken line in FIG. 8.

Now assume that current I2 decreases below the new constant current I33*b* when temperature T is lower than a prescribed temperature T3, which is lower than the first prescribed temperature T1. Then, the base current Ib18 fails to flow into the base of shutoff control transistor 18. Therefore, shutoff control transistor 18 is deactivated and bias supply transistor 20 again begins to supply the external circuit with the bias current.

Figure 8:
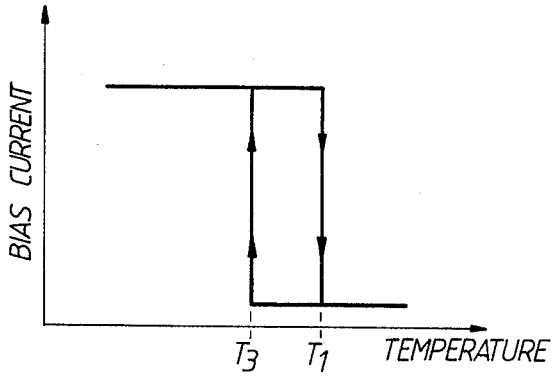
FIG. 8 is a graph showing the thermal hysteresis characteristic of the bias current obtained in the thermal shutoff circuit shown in FIG. 3.

As a result, the temperature hysteresis characteristic of the supply current or the shutoff of the bias current, as shown in FIG. 8, can be obtained. In this case, if the second prescribed temperature T3 is set to a temperature at which circuit elements of the thermal shutoff circuit are sufficiently cooled, the reliability of the thermal shutoff circuit is further improved.

Figure 9:
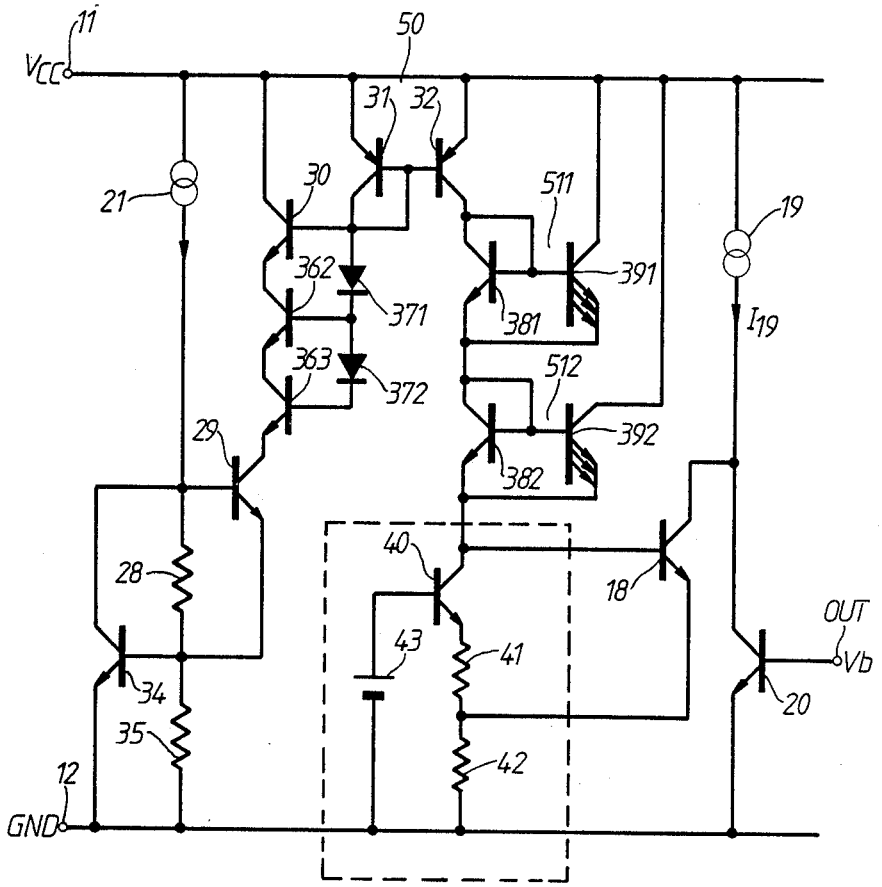
FIG. 9 is a circuit diagram, in which the improvements shown in FIGS. 4 to 7 are added to the thermal shutoff circuit shown in FIG. 3.

FIG. 9 shows a circuit diagram, in which the improvements shown in FIGS. 4 to 7 are added to the first embodiment of the thermal shutoff circuit shown in FIG. 3. Explanations of the circuit construction and its operation are omitted, but they will be self-explanatory from the above description and the drawings, namely FIGS. 4 to 8.

Accordingly, in the thermal shutoff circuit according to the present invention, the temperature at which the thermal shutoff operation is performed, e.g., the prescribed temperature T1, is not influenced by variations of the current amplification ratio $\beta$ of transistors. Furthermore, since the base potential for activating a temperature detection transistor, e.g., transistor 29, can be set for activation at an extremely low temperature the temperature at which the thermal shutoff operation begins can be set to an extremely low value. The thermal shutoff circuit according to the present invention is, therefore, suitable for application to monolithic integrated circuits.

As described above, the present invention provides a thermal shutoff circuit in which the temperature at which the thermal shutoff operation begins is stable and uniform regardless of variations in different integrated circuits, and which can be used with a low power supply voltage.

What is claimed is:

1. A thermal shutoff circuit for controlling current to an external circuit in response to changes in the temperature of the shutoff circuit, comprising:
   - means for supplying a voltage which varies with changes in temperature; and
   - switch means, responsive to the temperature variable voltage, for interrupting the current to the external circuit when the temperature of the shutoff circuit exceeds a predetermined amount, said switch means including
     - transistor means for compensating for variations in the current amplification ratios of other transistors in said thermal shutoff circuit, said transistor means including
       - a detection transistor having a base current responsive to the temperature variable voltage, and
       - a compensation transistor connected in series to the detection transistor for generating an equivalent base current to the base current of the detection transistor.

2. The thermal shutoff circuit of claim 1 wherein the switch means also includes:
   - bias current supply means for supplying a bias current to the external circuit;
   - shutoff control means for controlling the bias current supply means; and
   - transfer means responsive to the equivalent base current for controlling current to the shutoff control means.

3. The thermal shutoff circuit of claim 2 wherein the bias current supply means includes:
   - a bias transistor for supplying the bias current to the external circuit; and
   - first constant current supply means connected in series with the bias transistor for supplying a first constant current to the bias transistor.

4. The thermal shutoff circuit of claim 3 wherein the shutoff control means includes:
   - a shutoff control transistor connected in parallel with the bias transistor, and in series with the first constant current supply means; and
   - second constant current supply means connected in series with the base-to-emitter path of the shutoff control transistor.

5. The thermal shutoff circuit of claim 2 wherein the transfer means includes:
   - means for amplifying the equivalent base current to a fixed amount.

6. The thermal shuttof circuit of claim 5 wherein the transfer means includes:
   - a current mirror circuit having a first pair of mirror transistors for transmitting the equivalent base current to the shutoff control means.

7. The thermal shutoff circuit of claim 6, wherein an output side transistor of the mirror transistors in the current mirror circuit has an emitter area a given amount times larger than the emitter area of a source side transistor of the mirror transistors.

8. The thermal shutoff circuit of claim 6 wherein the amplifying means includes:

sub compensation transistor circuit means connected between the compensation transistor and the detection transistor for generating a sub equivalent base current, and adding the second equivalent base current to the first equivalent base current generated by the compensation transistor.

9. The thermal shutoff circuit of claim 8 wherein the sub compensation transistor circuit means includes:

at least one sub compensation transistor connected in series with the compensation transistor; and a diode connected between the bases of the compensation transistor and the sub compensation transistor.

10. The thermal shutoff circuit of claim 6 wherein the amplifying means also includes:

current amplifying mirror circuit means connected between the current mirror circuit and the shutoff control transistor for amplifying the equivalent base current to a given amount.

11. The thermal shutoff circuit of claim 10 wherein the current amplifying mirror circuit means includes:

at least one current amplifying mirror curcuit having a second pair of mirror transistors, an output side transistor of the second pair of mirror transistors having an emitter area a given amount times larger than the emitter area of a source side transistor of the second pair of mirror transistors.

12. The thermal shutoff circuit of claim 1 wherein the temperature variable voltage supplying means includes:

a temperature variable current source; and a means responsive to the temperature variable current for applying the temperature variable voltage to the detection transistor, the temperature variable voltage supplying means being connected in series with the temperature variable current source, and in parallel to the detection transistor.

13. The thermal shutoff circuit of claim 12 wherein the temperature variable voltage supplying means includes:

a first resistor connected in parallel with the base-to-emitter path of the detection transistor.

14. The thermal shutoff circuit of claim 13 wherein the temperature variable voltage supplying means also includes:

a current limiting means including a current limiting transistor connected at its collector to the base-to-emitter path of the detection transistor in parallel with the first resistor and a second resistor, connected in parallel with the base-to-emitter path of the current limiting transistor.

15. The thermal shutoff circuit of claim 3 wherein the first constant current supply means includes:

a current source transistor connected in parallel with the base-to-emitter path of the shutoff control transistor;

a base bias voltage source for supplying a base bias voltage to the current source transistor; and a current source resistor means having a first current source resistor connected between the emitters of the current source transistor and the shutoff control transistor and a second current source resistor connected between the first current source resistor and the base bias voltage source.

* * * * *